US006460783B1

(12) United States Patent
Christopher

(10) Patent No.: US 6,460,783 B1
(45) Date of Patent: Oct. 8, 2002

(54) TURBO SPRAY NOZZLE APPARATUS

(76) Inventor: Gilman O. Christopher, 924 W. 11th Pl., Mesa, AZ (US) 85201

( * ) Notice: Subject to any disclaimer, the term of this patent is extended or adjusted under 35 U.S.C. 154(b) by 0 days.

(21) Appl. No.: 09/920,119

(22) Filed: Aug. 2, 2001

(51) Int. Cl.[7] ..... A62C 31/02

(52) U.S. Cl. ..... 239/394; 239/391; 239/392; 239/436

(58) Field of Search ..... 239/73, 390, 391, 239/392, 394, 396, 436, 437, 451, 380, 381, 382, 538, 540, 550, 600

(56) References Cited

U.S. PATENT DOCUMENTS 2,388,093 A * 10/1945 Smith ..... 239/394
2,790,680 A * 4/1957 Rosholt ..... 239/394 X
3,516,611 A * 6/1970 Piggott ..... 239/394
3,596,835 A * 8/1971 Smith et al. ..... 239/394
4,043,511 A * 8/1977 Nakumura ..... 239/394
4,221,334 A * 9/1980 Christopher ..... 239/394
4,976,467 A * 12/1990 Paige ..... 239/394 X
5,884,847 A * 3/1999 Christopher ..... 239/394 X

* cited by examiner

*Primary Examiner*—Steven J. Ganey
(74) *Attorney, Agent, or Firm*—H. Gordon Shields

(57) ABSTRACT

Nozzle spray apparatus includes a turbo chamber into which fluid flows and out of which fluid flows to a nozzle. The inlet and outlet apertures or orifices are misaligned from each other and the outlet orifice or aperture is larger than the inlet orifice or aperture, thus allowing the pressure in the chamber to decrease and allowing fluid droplets to form as they flow out of the chamber. The apparatus includes both selectable quantity and droplet size capabilities by means of a selector plate rotatable relative to a base and having a plurality of metering apertures and the turbo chamber in a nozzle holder plate. The nozzle holder plate is rotatable relative to the base and holds a plurality of nozzles, any of which may be aligned with a desired aperture in the selector plate.

21 Claims, 3 Drawing Sheets

TURBO SPRAY NOZZLE APPARATUS

BACKGROUND OF THE INVENTION

1. Field of the Invention

This invention relates to spray apparatus and, more particularly, to spray apparatus for controlling the size of droplets being sprayed.

2. Description of the Prior Art

U.S. Pat. No. 5,333,790, the inventor of which is the inventor herein, discloses quick disconnect nozzle apparatus which may be used with the apparatus of the present invention. U.S. Pat. No. 5,884,847, the inventor of which is also the inventor herein, discloses spray nozzle apparatus with multiple nozzles. The operator of the apparatus may select a nozzle to provide a particular pattern or a particular quantity of fluid being sprayed.

The apparatus of the present invention allows an operator to select both a quantity of fluid to be sprayed and a droplet size for the fluid.

Controlling a droplet size according to weather conditions at the time that an operator is spraying is important that drift characteristics vary according to droplet size and weather conditions, or specifically wind conditions. The larger the droplet size, the less drift in accordance with wind conditions. The apparatus of the present invention lets an operator control both the quantity of liquid being sprayed and the droplet size.

SUMMARY OF THE INVENTION

The invention described and claimed herein comprises spray apparatus with selectable quantity and droplet size capabilities. The droplet size is controlled by a chamber into which fluid flows and out of which the fluid flows. The apertures through which fluid flows into the chamber is offset from the aperture through which the fluid flows out of the chamber. The outlet aperture or orifice is larger than the inlet aperture or orifice, thus allowing for a reduction in pressure and accordingly an increase in droplet size. The chamber is referred to as a turbo chamber in that the liquid flowing into the chamber swirls in a turbine fashion prior to leaving the chamber. Illustratively, three nozzle sizes are shown and several quantity selectors are shown.

Among the objects of the present invention are the following:

To provide new and useful liquid spray apparatus;

To provide new and useful spray apparatus having selectable droplet size capabilities;

To provide new and useful spray apparatus including selectable quantity and droplet size capabilities;

To provide new and useful spray apparatus having a turbo chamber to provide a drop in pressure of fluid to be sprayed;

To provide new and useful spray apparatus including a turbo chamber into which fluid flows and out of which fluid flows to a nozzle; and To provide new and useful spray apparatus including a chamber having an inlet aperture or orifice offset from an outlet aperture or orifice.

DESCRIPTION OF THE PREFERRED EMBODIMENT

Figures 1, 2, 3:
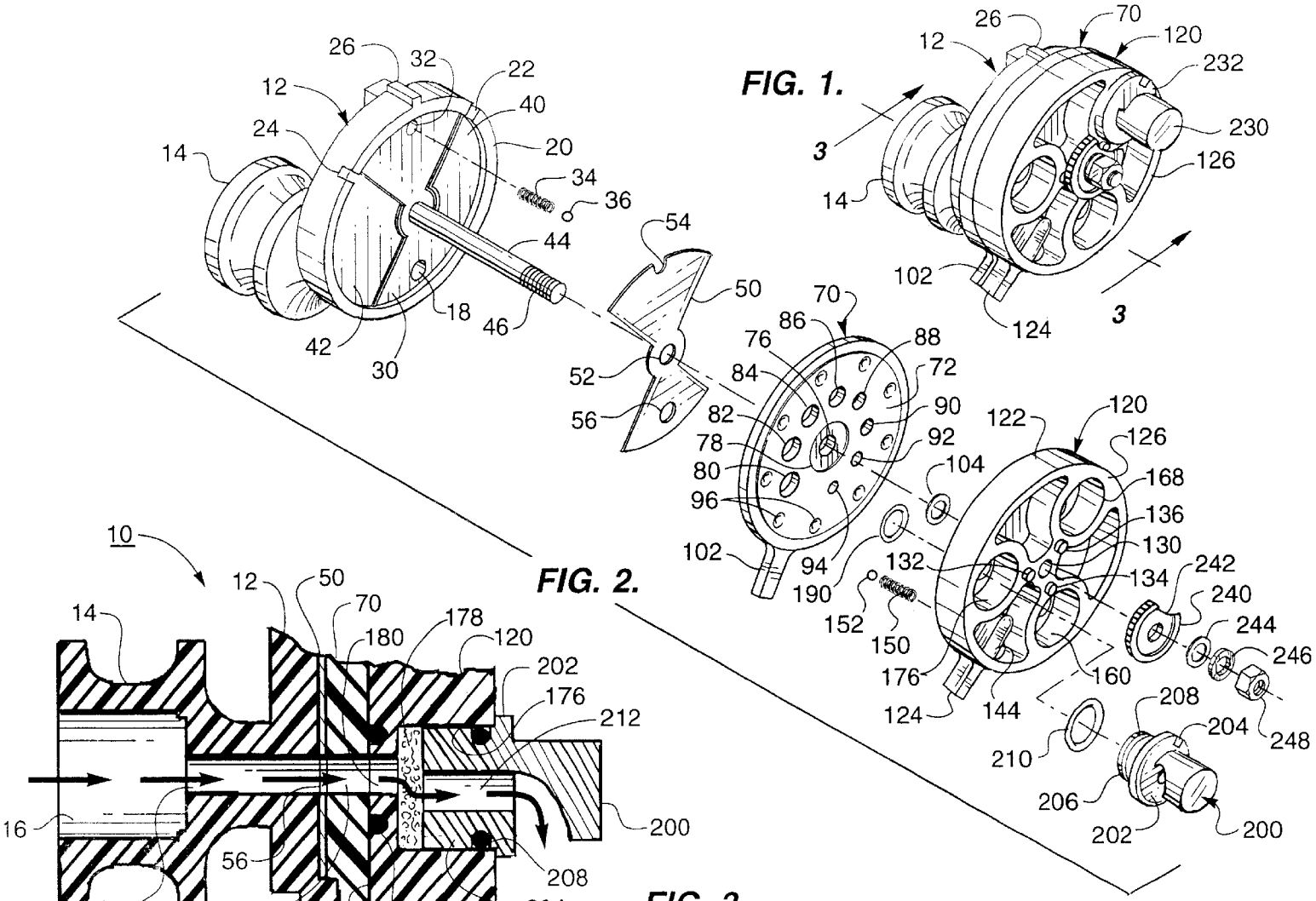
FIG. 1 is a perspective view of the apparatus of the present invention.
FIG. 2 is an exploded perspective view of the apparatus of FIG. 1.
FIG. 3 is a view in partial section of a portion of the apparatus of the present invention.

FIG. 1 is a perspective view of turbo spray nozzle apparatus 10 of the present invention. FIG. 2 is an exploded perspective view of the turbo spray nozzle apparatus 10 of FIG. 1. FIG. 3 is a view in partial section taken through a portion of the assembled turbo spray nozzle apparatus illustrated in FIGS. 1 and 2. For the following discussion, reference will primarily be made to FIGS. 1, 2, and 3.

The turbo spray nozzle apparatus 10 includes a base 12 to which is secured a cam lock body 14. The cam lock body 14 includes a connector bore 16 for connecting the cam lock body to the supply of fluid to be sprayed. The supply of fluid to be sprayed is schematically illustrated in FIG. 3 by the relatively large arrow extending into the connector bore 16 at the left of the figure. The path of the fluid through the apparatus 10 is then represented by the next consecutive relatively large arrows extending to the right in the figure. Extending outwardly from the connector bore 16 is a fluid bore 18.

The base 12 also includes an outer rim 20, and two slots 22 and 24 extend downwardly through the rim 20. The slots 22 and 24 extend to a pair of raised portions 40 and 42. The raised portions 40 and 42 are downwardly from the rim, but slightly outwardly from a seal recess 30.

The seal recess 30 includes two bores, including an upper bore 32 which receives a spring 34 and a ball 36. Extending through the lower portion of the seal recess 30 is the fluid bore 18.

Extending upwardly above the rim 20 is an index land 26. The purpose of the index land 26 is to help align a selector plate 70, and a nozzle holder 120, both of which will be discussed below, to the base 12.

Extending outwardly from the base 12 and located centrally with respect to the base 12, is a stem 44. The outer portion of the stem 44 comprises a threaded portion 46. The selector plate 70 and the nozzle holder 120 are secured to the base 12 by means of the stem 44. This will also be discussed below.

Disposed in the seal recess 30 is a seal plate 50. It will be noted that the configuration of the seal recess 30 is a fanciful "X" configuration, and the seal plate 50 is essentially the same configuration. The seal plate 50 includes a center hole 52 through which the stem 44 extends. At the upper portion of the seal plate 50 is a notch 54 which is aligned with the bore 32 and with the spring 23 and the ball 36. The lower portion of the seal plate 50 is a liquid hole or aperture 56. The liquid aperture or hole 56 is, of course, aligned with the fluid bore 18 of the base 12.

Figure 4:
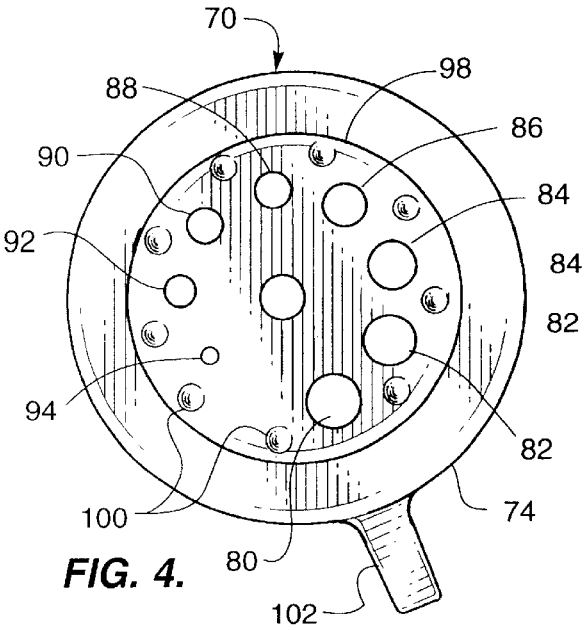
FIG. 4 is a rear view of a portion of the apparatus of the present invention.
Figure 5:
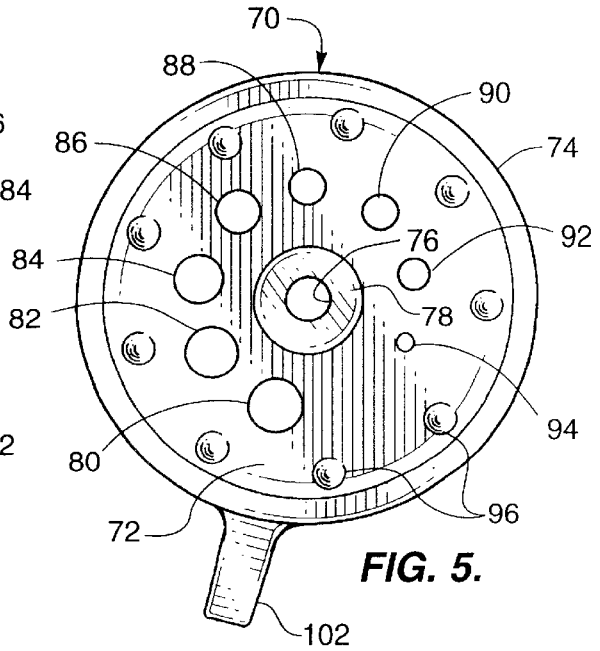
FIG. 5 is a front view of the apparatus of FIG. 4.

Disposed against the seal plate 50 and on the base 12 is the selector plate 70. FIG. 4 is a rear view of the selector plate 70, and FIG. 5 is a front view of the selector plate 70. For the following discussion reference will be made to FIGS. 4 and 5, in addition to FIGS. 1, 2, and 3.

The selector plate 70 includes a front face, shown in FIG. 2. A rim 74 extends circumferentially about the selector plate 70 and about the front face 52. Extending through the selector plate 70 is an aperture 76. The aperture 76 is aligned with the aperture 52 in the seal plate 50 and accordingly receives the stem 44 of the base 12. Extending downwardly into the front face 72 is a seal recess 78. The seal recess 78 receives a stem seal O-ring 104.

Extending through the selector plate 70 are metering apertures, including metering apertures 80, 82, 84, 86, 88, 90, 92, and 94. The metering apertures 80 . . . 94 each have different diameters, with the metering aperture 80 having the largest diameter and the metering aperture 94 having the smallest diameter. The diameter of the metering apertures determines the quantity of liquid sprayed by the apparatus 10. The greatest quantity flows through the largest diameter aperture, etc.

Also on the front face 72 are a plurality of index dimples 94. The index dimples 94 cooperate with a spring 150 and ball 152, which will be discussed below.

On the rear face 98 of the selector plate 70 are index dimples 100. The index dimples 100 cooperate with the ball 36, as biased by its spring 34, as the selector plate 70 is rotated to align one of the metering apertures 80 . . . 94 with the fluid bore 18 of the base 12.

Extending outwardly from the rim 74 is a selector handle 102. The selector handle 102 extends radially outwardly from the rim 74 and is used to rotate the selector plate 70 relative to the base 12 and also to the nozzle holder 120. Thus, an operator of the apparatus 10 may move the handle 102 about the stem 44 to index one of the metering apertures 80 . . . 94 to select the desired quantity of liquid to be sprayed.

Returning primarily to FIG. 2, the compression spring 34 is disposed in the bore 32, and bears against the ball 36. The ball 36 is an index ball that extends through the notch 54 in the seal plate 50 and seats in one of the index dimples 100 to provide a positive indication of the location of one of the metering apertures 80 . . . 94 relative to the fluid bore 18.

Figure 8:
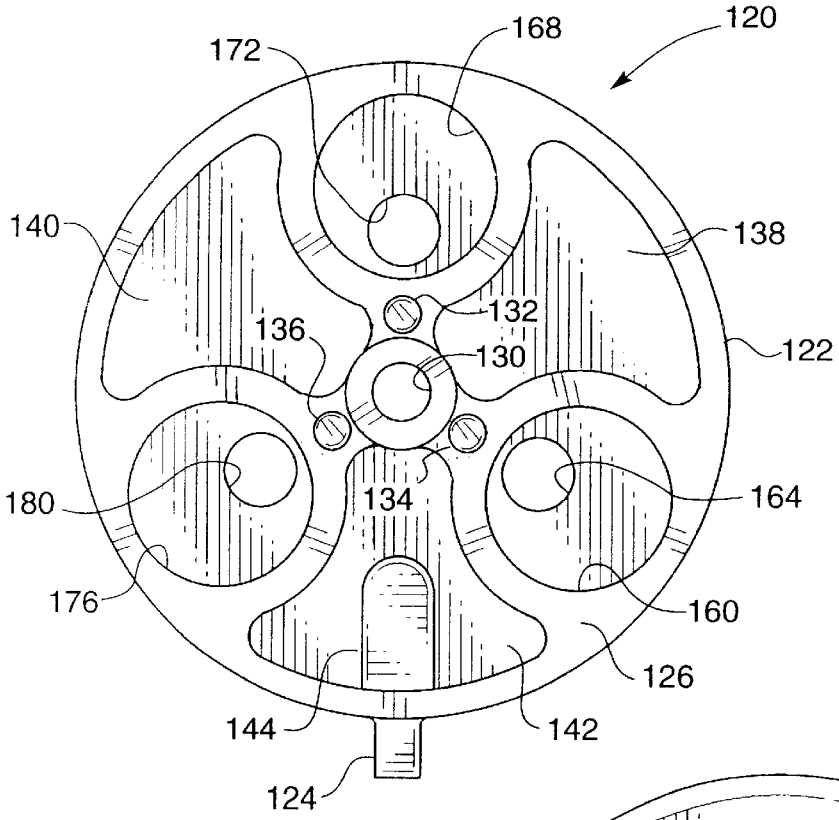
FIG. 8 is a front view of a portion of the apparatus of FIG. 6.
Figure 9:
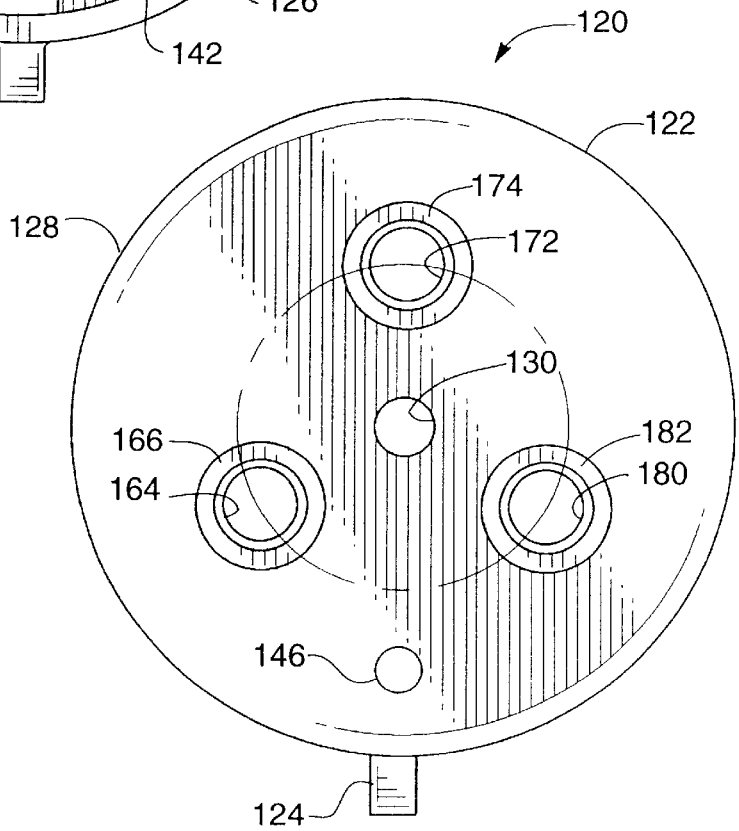
FIG. 9 is a rear view of the apparatus of FIG. 8.

Adjacent to the selector plate 70 is the nozzle holder plate 120. The nozzle holder plate 120 is shown in FIG. 2, and perhaps is best shown in FIGS. 8 and 9. FIG. 8 is a front plan view of the nozzle holder plate 120, and FIG. 9 is a plan view of the back or rear side of the nozzle holder plate 120. A portion of the nozzle holder plate 120 is also shown in FIG. 3 in partial section. For the following discussion, reference will be made to FIGS. 8 and 9, in addition to FIGS. 1, 2, and 3.

The nozzle holder plate 120 includes an outer rim 122, and a selector handle 120 extends radially outwardly from the rim 122. The nozzle holder plate 120 includes a front face 126 and a rear face 128. The front face 126 is shown in FIGS. 1, 2, 3, and 8, while the rear face 128 is shown in FIG. 9.

A center aperture center aperture 130 extends through the nozzle holder plate 120 and is aligned with the center aperture 76 of the selector plate 70, the center aperture 52 and the seal plate 50, and with the stem 44 of the base 12.

The center aperture, of course, receives the stem 44, with the threaded portion 46 of the stem 44 extending beyond the front face 126.

Spaced apart outwardly from the center aperture 130 are three locating or indexing pins, including a pin 132, a pin 134, and a pin 136. The pins cooperate with notches in the nozzles or tips to properly orient or align the nozzles or tips in their respective nozzle bores in the nozzle plates. Since the nozzle holder plate 120 rotates to align a desired nozzle or tip with a desired metering aperture in the selector plate 70, the nozzles or tips must be properly indexed with respect to the nozzle plate in order to properly align the nozzles or tips for spraying.

Adjacent to the locating pins, and extending downwardly or inwardly from the front face 126, are three relieved areas 138, 140, and 142.

Generally aligned with the selector handle 124, and extending into the relieved area 140, is a boss 144. Extending into the boss 144 from the rear side 148 is a bore 146. The bore 146 receives a spring 150 and a ball 152. The ball 152 is biased outwardly by the compression spring 150 into one of the index dimples 96 on the front face 72 of the selector plate 70 to align a selected one of the metering apertures 80 . . . 94 of the selector plate 70 with a nozzle disposed in a nozzle bore of the nozzle holder plate 120. The ball 152 and the index dimples 96 provide a positive indication of the alignment of a nozzle or tip on the nozzle holder 120 with a metering aperture on the metering plate70, just as the ball 36 and the dimples 100 provide a positive indication of the alignment of a metering aperture with the fluid delivery bore 18.

Extending inwardly from the front face 126 are three nozzle bores 160, 168, and 176. The nozzle bores are best shown in FIG. 8.

Each nozzle bore includes a fluid bore through which the fluid flows to the particular nozzle or tip disposed in the nozzle bore, and the fluid bores are located off-center, or are misaligned, with respect to the nozzle bores. This again is best shown in FIG. 8. This also may be understood from FIG. 3. That is, as best shown in FIGS. 3 and 8, the fluid bores are not centered with respect to their nozzle bores. However, the fluid bores are aligned with the respective fluid bore 18 of the base 12, and the aperture 56 in the seal plate 50, and with a metering bore of the selector plate 70.

The nozzle bore 160 includes a fluid bore 164, the nozzle bore 168 includes a fluid bore 172, and the nozzle bore 176 includes a fluid bore 180. In FIG. 3, the fluid bore 180 of the nozzle holder plate 120 is shown aligned with the metering bore 80, the aperture 56 of the seal plate 50, and the fluid bore 18 of the base 12. However, the fluid bore 180 of the nozzle bore 176 is misaligned with respect to a fluid delivery bore 210 of a nozzle or tip 200, located in the bore 176.

The desired fluid bore of the nozzle holder plate 120 may be appropriately aligned with a desired metering aperture of the selector plate 170 to provide the desired quantity and spray droplet size by rotating the plate 120. Each nozzle or tip disposed in a nozzle bore has a fluid delivery bore of a different size, and the size of the delivery bore of a nozzle or tip determines the size of the droplets sprayed by the apparatus 10. As indicated above, the quantity of spray is determined by the size or diameter of the metering apertures in the selector plate 70, while the droplet size is determined by the size or diameter of the delivery bore of the nozzles in the nozzle holder plate 120.

Disposed concentrically about fluid bores 164, 172, and 180 on the fear face 128 of the nozzle holder plate 120 are seal bore O-ring grooves 166, 174, and 182, respectively. These are best shown in FIG. 9. In FIG. 3, an O-ring seal 190 is shown disposed in the O-ring groove 182 (See FIG. 9) to seal the fluid bore 180 with respect to the selector plate 70.

In FIG. 3, a nozzle or tip 200 is shown disposed in the nozzle bore 176. Details of the nozzle 200, the nozzle bore 176, and related elements, are best shown in partial section in FIG. 3. For the following discussion, reference will primarily be made to FIGS. 2 and 3.

The nozzle 200 includes an outwardly extending flange 202 which has a diameter slightly larger than that of a cylindrical nozzle barrel 206. On the flange 202 is an indexing notch 204. The nozzle 200 also includes an O-ring groove 208 extending inwardly on the barrel 206 and adjacent to the flange 202. An O-ring 210 is shown disposed in the O-ring groove 208 in FIG. 3. The O-ring 210 is shown spaced apart from the O-ring groove 208 in Fig. 2.

The notch 204 receives the locating pin 132 to properly orient the nozzle or tip 200 in the nozzle bore 176, as discussed above.

As best shown in FIG. 3, the flange 202 limits the inward movement or location of the nozzle 200 with respect to the nozzle bore 176. Between the rear end of the nozzle 200, and specifically the rear end of the nozzle barrel 206, and the bottom or rear end of the nozzle bore 176 is a turbo chamber 178. The turbo chamber 178 communicates with the fluid bore 180 in the nozzle holder plate 120 and the delivery bore 212 of the nozzle 200. The turbo chamber 178 is part of the nozzle bore 176. The size of the turbo chamber is determined by the overall length of the bore 176 and the length of the barrel 206. Since the flange 202 limits the extent to which the tip or nozzle 200 may be inserted into the bore 176, the size of the turbo chamber 178 is fixed with respect to a specific nozzle.

The fluid bore 180 is aligned with the bores 18, 56, and 80, but the nozzle delivery bore 212 is shown in FIG. 3 to be offset from the aligned bores 18, 56, 80 and 180. The offset or misalignment, and the presence of the turbo chamberl78, provides for the turbulence in the fluid flowing through the apparatus 10 and provides a distinct drop in pressure of the fluid flow, and accordingly determines the configuration or size of the fluid droplets of the fluid flowing from the nozzle 200.

The large arrows in FIG. 3 show the passage of the fluid through the apparatus 10, as mentioned above. The wavy, squiggly lines in the turbo chamber 178 help to reinforce the concept of the movement of the liquid or fluid in the chamber 178 prior to the fluid flow out through the delivery bore 212 of the nozzle 200.

FIG. 3 also shows the relative diameters of the respective bores through which fluid flows. It will be noted that the diameter of the fluid delivery bore 212 of the nozzle 200 is greater than the diameter of the aligned bores 18, 80, and 180, thus allowing the pressure in the turbo chamber 178 to decrease. The decrease in pressure allows fluid droplets to form as they flow from the chamber 178 into the delivery bore 212 of the nozzle 200.

In FIG. 1 is shown a nozzle or tip 230. The nozzle 230 has a flange 232. The nozzle 230 is held in place in its nozzle bore by a segmented wheel 240 (See FIG. 2). The wheel 240 includes a segmented peripheral space 242 which is arcuately configured with the same radius as that of the flange 202 of the nozzle 200, and accordingly of the flange 232 of nozzle 230 as may be understood from FIG. 1. The wheel 242 is disposed on the stem 44 and is movable thereon. The height of the index pins 132, 134, and 136 is the same as the height of the respective flanges of the nozzles, and the wheel 240 has a diameter sufficiently large to be disposed over a portion of each of the nozzle flanges so as to hold the nozzles in place in their respective bores.

The purpose of the segmented space 242 is to allow a nozzle to be changed without completely taking the apparatus 10 apart, or even loosening the nut 248. When it is desired to change a nozzle, the segmented portion 242 is simply rotated to the particular nozzle to be changed. With the segmented portion 242 disposed at a nozzle location, the portion 242 uncovers the adjacent flange portion of a nozzle, thus allowing a nozzle to be removed from its nozzle bore and another nozzle to be inserted therein.

When the new nozzle is inserted into the nozzle bore, the wheel 240 is simply rotated to move the segment space 242 away from a nozzle flange, or adjacent to one of the relieved areas or portions 138, 140, and 142, as may best be understood in FIG. 8.

Adjacent to the wheel 240 is a washer 244, which is preferably made of "Teflon" material. The purpose of the washer 244 is to decrease the friction between the wheel 240 and a lock washer 246 and a nut 248. The nut 248 is disposed on the threaded portion 46 of the stem 44 and against the washer 246, which in turn bears against the washer 244 to hold the wheel 240 in place. Holding the wheel 240 in place in turn holds the nozzles 200, 220, and 230 in their respective nozzle bores.

The three nozzles 200, 220, and 230, disposed in the nozzle bores 176, 160, and 168, respectively, of the nozzle holder plate 120, along with the eight metering apertures 80 . . . 94 in the selector plate 70, provide a relatively wide range of droplet size and fluid flow rates. However, under some circumstances it may be desirable to include a second selector plate adjacent to and parallel with the selector plate 70. A second selector plate is illustrated in FIGS. 6 and 7.

Figure 6:
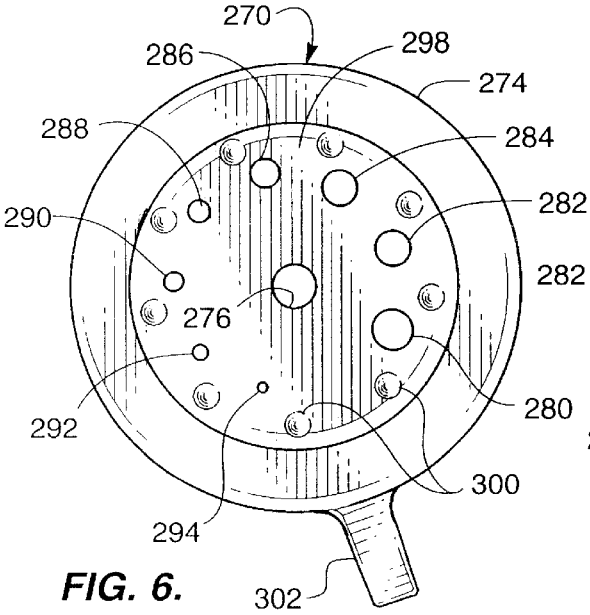
FIG. 6 is a rear view of another portion of the apparatus of the present invention.
Figure 7:
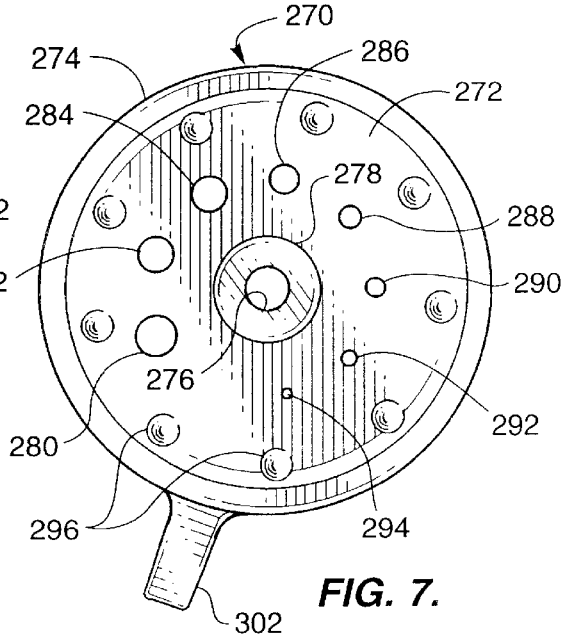
FIG. 7 is a front view of the apparatus of FIG. 6.

FIG. 6 comprises a rear plan view of a selector plate 270, and FIG. 7 comprises a front plan view of the selector plate 270. The selector plate 270 is substantially identical, in general configuration, to the selector plate 70. Thus, the selector plate 270 includes a front face 272 bounded by a rim 274. The selector plate 270 also includes a center aperture 276 which receives the stem 44 of the base 12.

On the front face 272, concentric to the hole or aperture 276, is a seal recess 278. Spaced apart from each other are eight metering apertures 280, 282, 284, 286, 288, 290, 292, and 294. It will be understood that the metering apertures 280 . . . 294, and the metering apertures 80 . . . 94 of the selector plate 70, are on a common circle so as to align with each other and with the nozzle bores 160, 168, 176, as may best be understood from FIGS. 8 and 9. In FIG. 9, there is a circle, concentric with the center aperture 130, to illustrate the location of the nozzle bores. The same circle may be superimposed on the metering apertures of the plates 70 of FIGS. 4 and 5 and 270 of FIGS. 6 and 7.

It will be noted that the metering apertures 280 . . . 294 of selector plate 70 each have a different diameter than those of the metering apertures 80 . . . 94 of the selector plate 70. The combination of the metering apertures of the selector plates 70 and 270, along with the use of three different sized nozzles, provide a greater range of fluid flows, with their respective droplet sizes, than may be obtained with the use of only a single selector plate. Moreover, the ease with which a nozzle may be changed increases the overall flexibility of the apparatus 10.

On the front face 272 of the selector plate 270 are spaced apart index dimples 296, and on the rear face 298 are index dimples 300. The respective dimples, of course, receive the balls for indexing the plates in a positive manner to their desired locations. The plate 270 is rotated by means of a selector handle 302. The selector handle 302 extend radially outwardly from the rim 274.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, within the limits only of the true spirit and scope of the invention.

What I claim is:

1. Turbo spray nozzle apparatus for spraying a fluid comprising in combination:

a base;

a fluid bore in the base;

a first selector plate adjacent to the base including at least a single metering aperture extending through the first selector plate and aligned with the fluid bore in the base;

a nozzle holder plate adjacent to the first selector plate, including at least a single nozzle bore for receiving a nozzle;

a fluid bore in the nozzle holder plate communicating with the nozzle bore and which fluid bore is aligned with the metering aperture in the first selector plate;

a nozzle in the nozzle bore, including a fluid delivery bore misaligned with the fluid bore in the nozzle holder plate; and a turbo chamber in the nozzle bore between the fluid bore and the fluid delivery bore of the nozzle.

2. The apparatus of claim 1 in which the first selector plate includes a plurality of metering apertures, each having a different diameter for providing a plurality of fluid flows.

3. The apparatus of claim 2 in which the base includes a stem, and the first selector plate is rotatable on the stem to align a selected metering aperture of the plurality of metering apertures with the fluid bore in the base.

4. The apparatus of claim 3 in which the nozzle holder plate is rotatable on the stem of the base.

5. The apparatus of claim 4 in which the nozzle holder plate includes a plurality of nozzle bores, and each nozzle bore receives a nozzle, and each nozzle includes a fluid delivery bore, and each fluid delivery bore has a different diameter for providing a different fluid droplet size, and each nozzle bore includes a fluid bore misaligned with the fluid delivery bore of its nozzle, and each nozzle bore includes a turbo chamber.

6. The apparatus of claim 5 in which the nozzle holder plate is rotatable on the stem for aligning a selected fluid bore of a nozzle bore with a selected metering aperture of the plurality of metering apertures of the first selector plate.

7. The apparatus of claim 6 which further includes a second selector plate having a second plurality of metering apertures, each aperture having a different diameter than the metering apertures of the first selector plate and which second selector plate is disposed adjacent to the first selector plate for providing a second plurality of fluid flows.

8. The apparatus of claim 7 in which the second selector plate is rotatable on the stem for aligning any one of the plurality of metering apertures of the second selector plate with any one of the plurality of metering apertures of the first selector plate.

9. The apparatus of claim 1 in which the nozzle bore has a first diameter and the nozzle includes a radially outwardly extending flange having a diameter greater than the first diameter of the nozzle bore to limit the depth of the nozzle in the nozzle bore, and the turbo chamber is rearwardly of the nozzle in the nozzle bore.

10. The apparatus of claim 1 in which the base includes a cam lock body for quickly attaching the base to a source of fluid to be sprayed.

11. The apparatus of claim 1 which further includes first index means for indexing the first selector plate to the base.

12. The apparatus of claim 4 which further includes second index means for indexing the nozzle holder plate to the first selector plate.

13. The apparatus of claim 1 in which the fluid bore in the base and the metering aperture and the fluid bore in the nozzle holder plate have diameters which are substantially the same, and the fluid delivery bore of the nozzle has a diameter which is greater than that of the fluid bores and the metering aperture to provide a drop in the pressure of the fluid in the turbo chamber.

14. The apparatus of claim 1 in which the nozzle includes a rim, and the rim has an indexing notch, and the nozzle holder plate includes an indexing pin which extends into the notch on the rim of the nozzle for indexing the nozzle to the nozzle holder plate for spraying.

15. The apparatus of claim 14 in which the nozzle holder plate includes a plurality of nozzle bores, and an indexing pin is disposed adjacent to each nozzle bore.

16. The apparatus of claim 15 in which a nozzle is disposed in each nozzle bore, and each nozzle includes a notched rim, and each notch receives an indexing pin to index each nozzle for spraying.

17. The apparatus of claim 16 which further includes a stem on the base and the nozzle holder plate rotates on the stem to align a selected one of the nozzles with the metering aperture of the selector plate.

18. The apparatus of claim 17 which further includes a wheel rotatable on the stem, and the wheel extends outwardly over the rims of the nozzles.

19. The apparatus of claim 17 in which the wheel includes a segment space, and the segment space is rotatable to a nozzle for removing and replacing the nozzle.

20. The apparatus of claim 1 which further includes a seal plate disposed between the base and the first selector plate.

21. The apparatus of claim 20 in which the base includes a recess for receiving the seal plate.

* * * * *